US005401107A

United States Patent [19]

Koike et al.

[11] Patent Number: 5,401,107

[45] Date of Patent: Mar. 28, 1995

[54] COMPONENT OF PRINTING HEAD FOR WIRE-IMPACT TYPE DOT PRINTER AND MOLDING METHOD THEREOF

[75] Inventors: Kiyofumi Koike; Minoru Tanaka, both of Suwa, Japan

[73] Assignee: Seiko Epson Corporation, Tokyo, Japan

[21] Appl. No.: 206,920

[22] Filed: Mar. 4, 1994

Related U.S. Application Data

[63] Continuation of Ser. No. 838,730, May 6, 1992, abandoned.

[30] Foreign Application Priority Data

Jul. 12, 1990 [JP] Japan ..... 2-186788

[51] Int. Cl.[6] ..... B41J 2/27

[52] U.S. Cl. ..... 400/124.26; 400/124.32

[58] Field of Search ..... 400/124, 124.26, 124.32; 101/92.05; 419/6, 5, 7, 8

[56] References Cited

U.S. PATENT DOCUMENTS

| | | | |
|---|---|---|---|
| 3,672,482 | 6/1972 | Brumbaugh et al. | 101/93.05 |
| 4,230,038 | 10/1980 | Herbert | 101/93.05 |
| 4,230,412 | 10/1980 | Herbert | 101/93.05 |
| 4,425,299 | 1/1984 | Koiso | 419/6 |
| 4,652,157 | 3/1987 | Uzawa | 420/441 |
| 4,661,002 | 4/1987 | Ara | 400/124 |
| 4,722,824 | 2/1988 | Wiech, Jr. | 419/6 |
| 4,833,980 | 5/1989 | Bringhurst | 400/121 |
| 5,007,979 | 11/1991 | Kiyota | 75/243 |
| 5,043,123 | 8/1991 | Gormanns et al. | 419/6 |
| 5,055,128 | 10/1991 | Kiyota | 75/246 |
| 5,141,554 | 6/1991 | Kijima | 75/242 |

FOREIGN PATENT DOCUMENTS

| | | |
|---|---|---|
| 56-131906 | 10/1981 | Japan . |
| 60-72747 | 4/1985 | Japan . |
| 1-299054 | 12/1989 | Japan . |

*Primary Examiner*—Edgar S. Burr
*Assistant Examiner*—John S. Hilten
*Attorney, Agent, or Firm*—Stroock & Stroock & Lavan

[57] ABSTRACT

Disclosed are a magnetic circuit component of an impact dot head and a molding method thereof by which the number of parts is reduced, and an excellent magnetic efficiency is exhibited.

At least one member among a plurality of members constituting a magnetic circuit component (e.g., a core block 1) of a printing head is injection-molded after kneading a binder with metallic powder of a magnetic substance. The single member is sintered by joining it to another molded member after effecting de-binder processing, thus manufacturing the component.

10 Claims, 5 Drawing Sheets

COMPONENT OF PRINTING HEAD FOR WIRE-IMPACT TYPE DOT PRINTER AND MOLDING METHOD THEREOF

This is a continuation of application Ser. No. 07/838,730, filed May 6, 1992, now abandoned.

TECHNICAL FIELD

The present invention relates to a component which constitutes a printing head for a wire impact type dot printer and a molding method thereof.

BACKGROUND ARTS

A printing head for a wire impact type dot printer is, as illustrated in FIG. 8, typically composed of: a nose frame a; a core block b fixed to a rear face thereof; a spring holder c provided in a central circular hole of the core block b; a yoke d mounted on the core block b; a multiplicity of printing levers l positioned and held on the yoke d; and a presser plate f which covers the printing levers.

Among these components, for instance, the core block b for constituting a magnetic circuit is constructed by joining a multiplicity of sub-cores b2 each formed of a material such as Permendur having a large saturated magnetic flux density in a soft iron base frame b1. The printing lever l is constructed by joining a lever l2 and a fulcrum pin l3 to a plunger l1 formed of Permendur. It requires a considerable number of steps to integrally joining these components. Besides, particularly in the core block b, a slight gap is invariably formed between the base frame and the core irrespective of the way of joining these members. This causes a magnetic loss. A backlash tends to be produced between the lever l2 and the fulcrum pin l3 of the printing lever l. There arise inconveniences in which wire motions become unstable, and adverse influences are exerted on the respondency.

DISCLOSURE OF THE INVENTION

It is an object of the present invention, which has been devised in the light of the foregoing problems, to provide a new wire impact type dot head component in which a plurality of members are made integral by sintering. Accordingly, it is another object of the present invention to provide a method of molding a new head component, by which a plurality of members are easily surely made integral.

To accomplish these objects, according to one aspect of the invention, there is provided a wire impact type dot head component characterized in that at least one member of a component configured as a joint body of a plurality of members is molded by use of metallic powder and then sintered, and this one member is integrally joined to another member in the above-described process. According to another aspect of the invention, there is provided a method of molding such a head component, comprising the steps of molding at least one member constituting the component by use of metallic powder by an injection molding method, sintering this one member and effecting integral sintering by joining this one member to another previously molded member in the above-described process.

Therefore, according to the present invention, at least one member among the plurality of members constituting the magnetic circuit component for a printing head is molded by use of the metallic powder by injection molding and subsequently sintered. In this process, the foregoing member is joined to another member previously molded, thus effecting integral sintering. Hence, the plurality of members can be joined integrally and easily without a particular working accuracy of the joint portion. It is possible to remarkably reduce the number of assembling steps and the number of parts as well. An inter-member gap is eliminated, whereby the magnetic circuit component with almost no magnetic loss can be constructed. Further, it is possible to mold the component in which an expensive material exhibiting a high permeability is applied to only the parts required. Thus, the printing head can be constructed at still lower costs.

BEST MODE FOR CARRYING OUT THE INVENTION

An illustrative embodiment of the present invention will hereinafter be described in detail.

Figure 1:
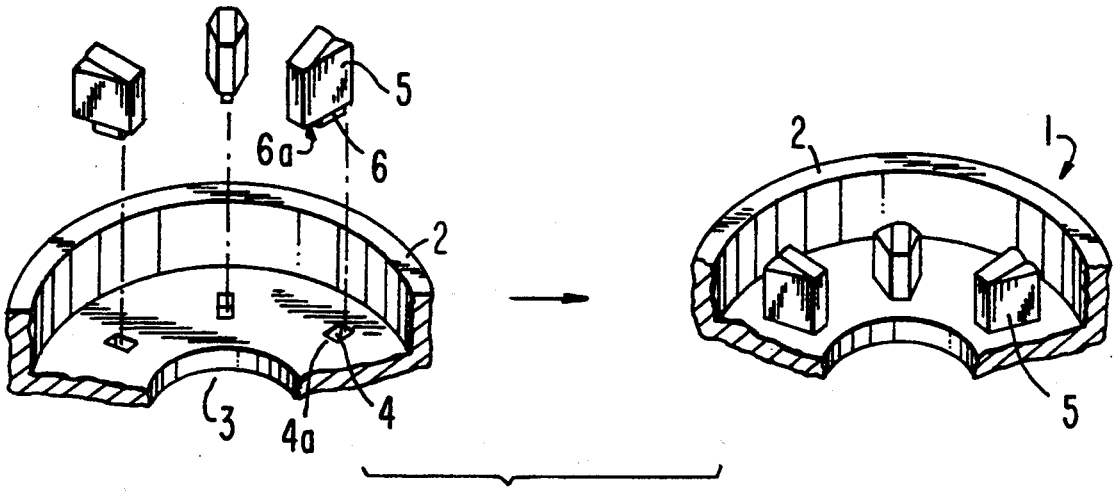
FIGS. 1, 2, 3, 4, 5 and 6 are perspective views and step charts showing integral joining steps of a printing head component.
Figure 2:
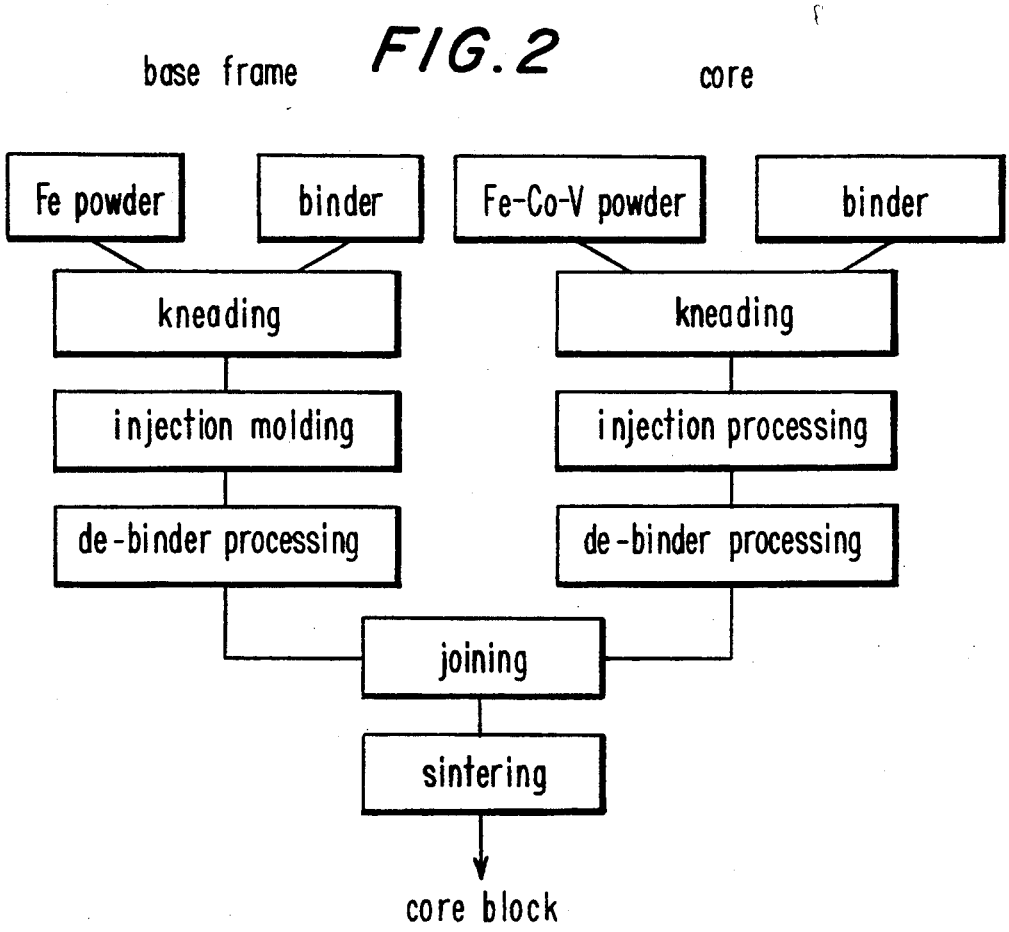

Referring to FIGS. 1 and 2, there is shown a molding method of a core block for configuring a magnetic circuit. Formation of one base frame 2 involves the steps of adding 5–60% by volume of an organic binder to powder of magnetic substance, having a particle diameter of 3–25M m, of pure iron Fe or 3% silicon steel Fe-Si and kneading these substances. Under an injection pressure of 300–3000 kgf/cm$^2$ by an injection molding machine, the kneaded substances are molded into a base frame prototype formed with a central circular hole 3 and a multiplicity of core fitting holes 4 . . . which encompass the hole 3 in an inner bottom face. Pin gates are employed as those required for the injection molding, resulting in a reduction in the remainder of gates. The base frame 2 formed by the injection molding is joined simply by the binder. The base frame 2 exhibits a high workability and is therefore capable of easily removing the gate remainder. The runner is pulverized and kneaded, whereby it is reusable for injection molding. The base frame 2 can be therefore inexpensive.

Next, de-binder processing is effected in an inert gas or in vacuum for 2–60 hrs at 300° C.–700° C. after being held for 1–3 hrs at, e.g., 50° C.–200° C. The binder composed of an organic substance is removed from the base frame 2.

The other core 5 is formed in the following manner. Kneaded with the binder in the same manner with as the above-mentioned is powder of Permendur (Fe-Co-V alloy) having a large saturated magnetic flux density or 3% silicon steel Fe-Si having a large permeability or a nickel alloy Fe-Ni. The kneaded substances are injection-molded into a core prototype provided with fitting protrusions 6 on its lower face. Then, it undergoes debinder processing.

Subsequently, the fitting protrusions 6 of the core prototype are fitted in the fitting holes 4 of the base frame prototype, thereby joining the two prototypes. More specifically, the base frame fitting hole 4 is formed in a substantially rectangular parallelopiped shape. The configuration of the core fitting protrusion 6 is substantially the same as the substantially rectangular parallelopiped. Positions of the base frame 2 and the core 5 are thereby easily determined. Besides, a stepped portion 6*a* of the core protrusion 6 impinges on a bottom part 4*a* of the base frame, thereby easily determining the position.

Figure 7:
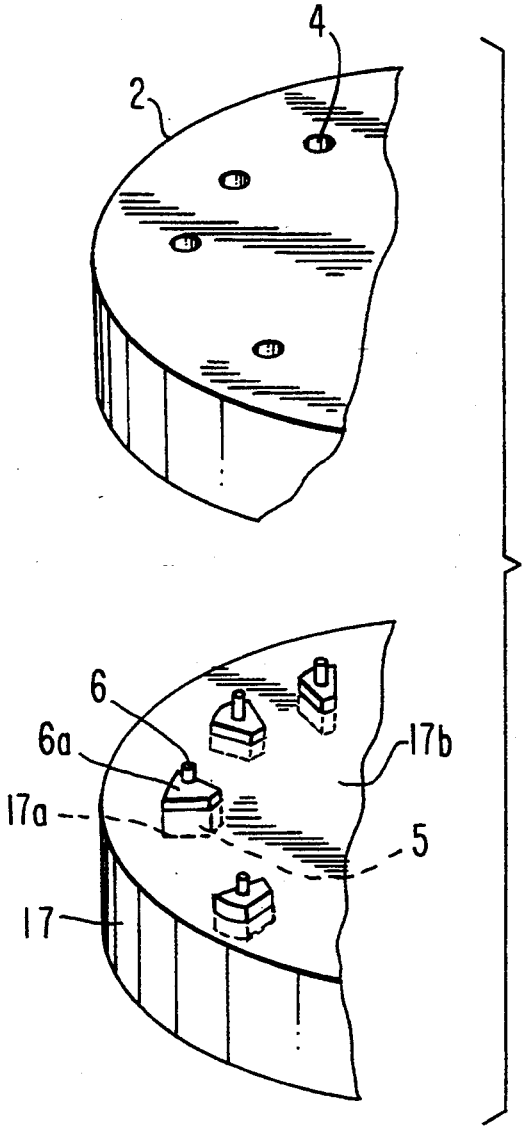
FIG. 7 is a perspective view showing the integral joining steps of the printing head component.
Figure 8:
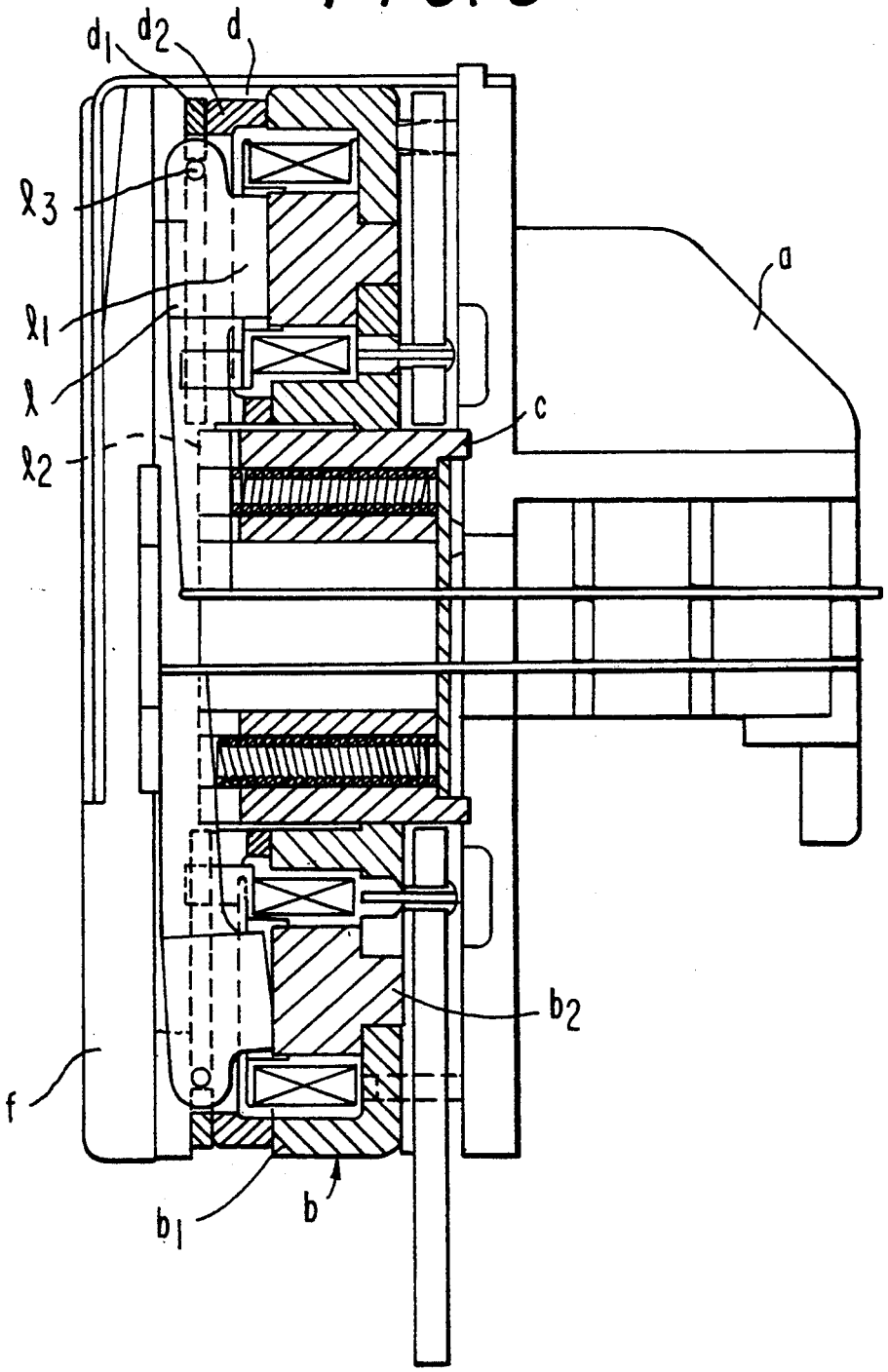
FIG. 8 is a view illustrating one example of a printing head for a wire impact type dot printer.

A method which uses a jig illustrated in FIG. 7 is also available. A jig 17 is formed with a groove 17*a* assuming a configuration corresponding to the core 5. The core 5 is inserted in this groove 17*a*. A depth of the groove 17*a* is so set that the stepped portion 6*a* of the protrusion 6 of the core 5 is higher than an upper face 17*b* of the jig. The core 5 is set in the jig 17. The fitting protrusion 6 of the core 5 is formed in, e.g., a substantially cylindrical shape, and the hole 4 of the base frame 2 assumes a configuration corresponding to the protrusion 6. The protrusions 6 are press-fitted in the holes 4, whereby the two members are joined. The joined body is sintered in vacuum or in an atmosphere of inert gas.

Molding is performed in this manner, interfaces between the base frame 2 and the cores 5 are welded. The base frame 2 and the cores 5 are integrally joined without any gap. A core block i with almost no magnetic loss is thereby obtained.

The following are test results of an input energy, an output energy and an energy efficiency $$\left(\frac{\text{output energy}}{\text{input energy}} \times 100\right)$$

by use of the core block molded by the above-mentioned method and a conventional core block in which the cores are joined with a bonding agent.

| | Input Energy | Output Energy | Energy Efficiency |
|---|---|---|---|
| Core Block by the Present Method | 4.3 mj | 0.4 mj | 9.3% |
| Conventional Method | 6.3 mj | 0.4 mj | 6.3% |

It can be found out from these results that the core block molded based on the method of the present invention exhibits a less magnetic loss and a higher energy efficiency than in the prior art.

Figure 3:
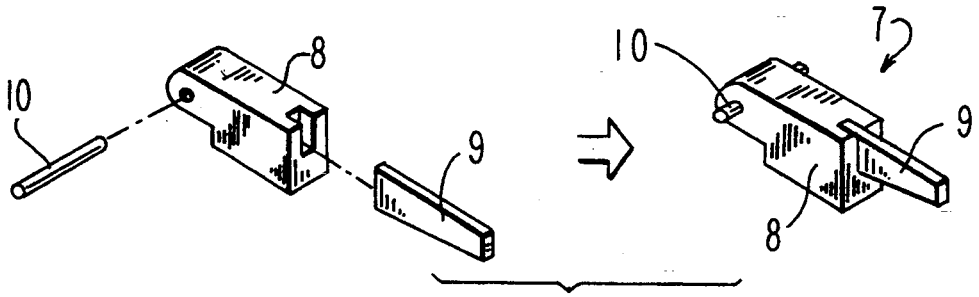
Figure 4:
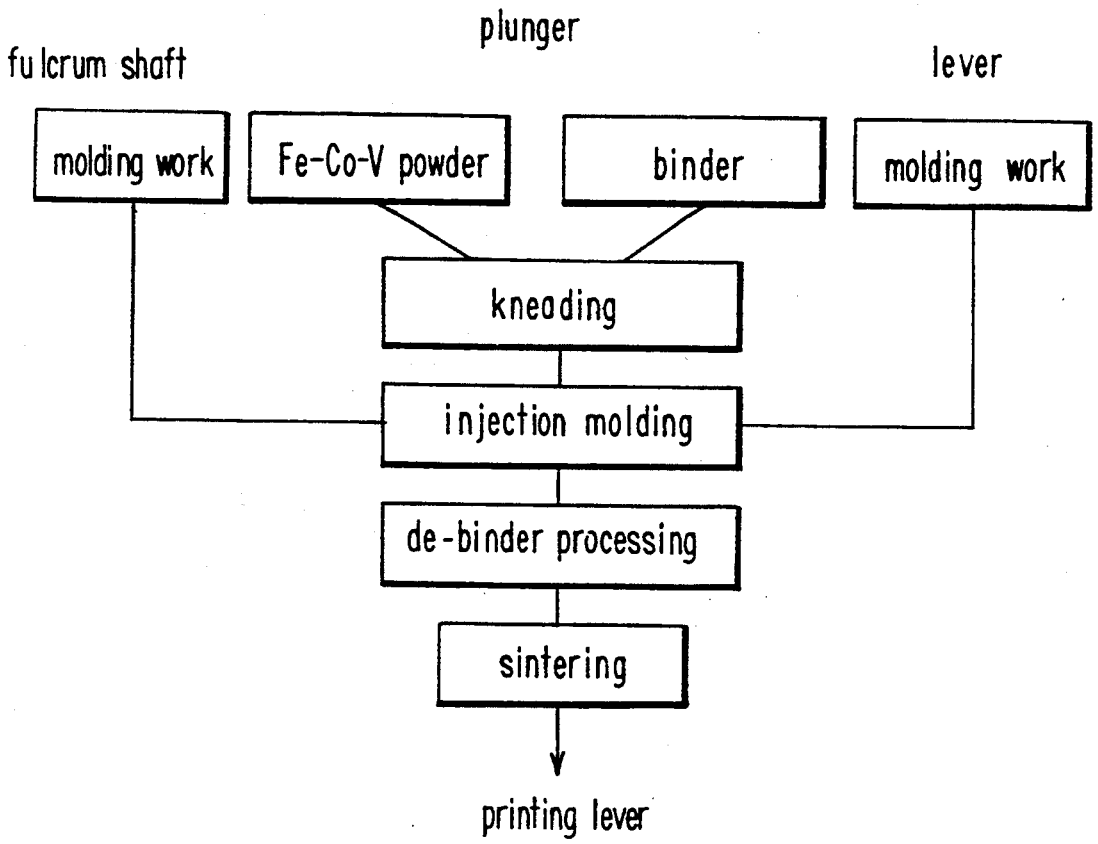

FIGS. 3 and 4 show a method of molding a printing lever 7. A lever piece 9 is previously molded by press working from a plate material of pure iron Fe or 3% silicon steel Fe-Si or stainless steel each having a high strength. A fulcrum pin 10 is also previously molded by cutting work from a wire rod composed of carbon steel and the like. These members are molded integrally with a prototype of a plunger 8 by an insert method in the process of injection-molding the plunger prototype with a molding die while kneading an organic binder with powder of a high saturated magnetic flux density alloy or a high permeability alloy such as Permendur Fe-Co-V and the like. Subsequently, these members undergo de-binder processing and sintered in vacuum in an atmosphere of inert gas.

The following is an explanation of another method. The binder is kneaded with powder of the high saturated magnetic flux density alloy or the high permeability alloy such as Permendur Fe-Co-V and the like. The plunger 8 is formed by injection molding. After effecting de-binder processing, the printing lever piece 9 is joined to the fulcrum pin 10. These members are sintered in vacuum or in the atmosphere of inert gas.

Molding is performed in the manner discussed above, and it is possible to obtain the printing lever 7 showing a high energy efficiency, using an expensive material with a high permeability for the plunger 8 alone. Besides, the lever piece 9 and the fulcrum pin 10 are accurately firmly made integral with a predetermined portion of the plunger 8. Thus, the operation thereof can be stabilized.

Figure 5:
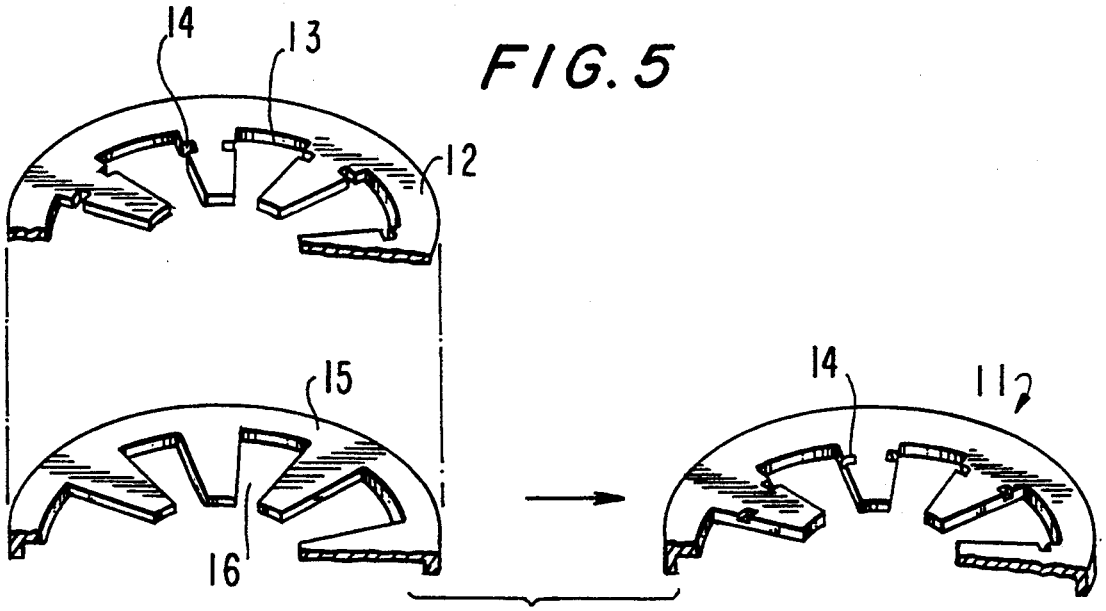
Figure 6:
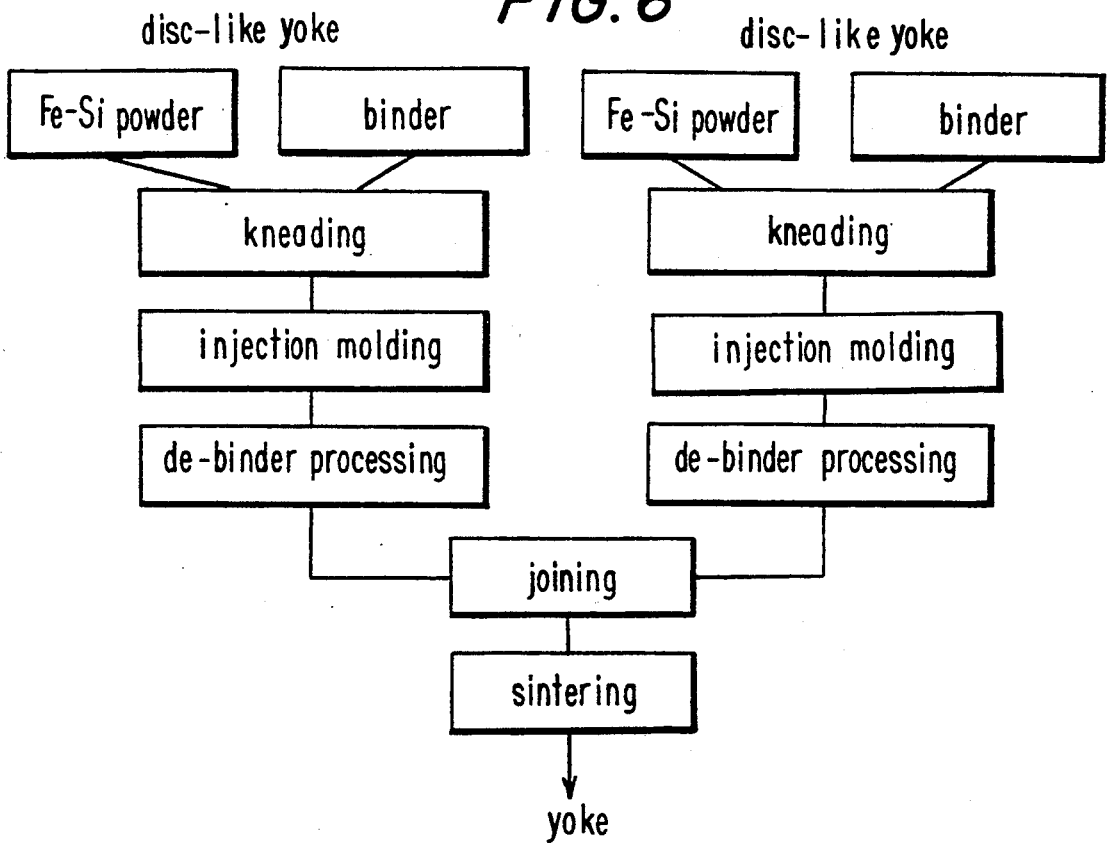

Turning to FIGS. 5 and B, there is shown a method of molding a yoke 11. A disk-like yoke 12 are formed with a multiplicity of radial grooves 13 . . . and fulcrum pin insertion recesses 14 . . . . A dish-like yoke 15 is formed with a multiplicity of radial grooves . . . . The yokes 12 and 15 are molded by injection molding from a raw material obtained by kneading the binder with powder of pure iron Fe, or silicon steel Fe-Si or Permendur (Fe-Co-V alloy) as a magnetic material. Those yokes are subjected to debinder processing. Subsequently, the prototypes of the yokes 12, 15 are superposed to align the radial grooves 13, 16 with each other and sintered in vacuum or in the atmosphere of inert gas.

Molding is carried out in this manner, whereby the two yokes which could not be formed integrally so far can be integrally molded into a single yoke 11. Left in the portion where the binder existed in this yoke are minute voids smaller than fine powder particles. It is because sintering is effected after injection-molding the fine powder with the binder. It is feasible to configure the yoke 11 capable of permitting the printing lever 7 to smoothly surely operate as a porous yoke exhibiting a less magnetic loss and self-lubricity because of a lubricating oil impregnating in those voids.

Note that the present invention has been described by exemplifying the component applied to a typical suction type wire impact dot head. In addition to this, the present invention is, however, applicable to yokes used for store energy type dot heads-using permanent magnets.

Namely, though the illustration is omitted, a permanent magnet is formed beforehand of a material such as samarium cobalt or neodymium. The yokes are previously molded by sintering or press working by use of a material such as pure iron Fe or silicon steel Fe-Si. These members are made integral with the base frame by an outsert method in the process of injection-molding the base frame prototype by kneading the binder with powder of a ferromagnetic substance such as silicon steel Fe-Si or Permendur Fe-Co-V. After undergoing de-binder processing, those members are sintered.

As a result, the yokes for constituting the magnetic circuit can be molded to reduce the magnetic loss to the greatest possible degree.

Industrial Applicability

The present invention is employed for the impact dot head of a dot printer and is applicable to all kinds of dot impact printers which will be spread from now onwards. The present invention largely contributes to an improvement of performance and a cost-down thereof.

What is claimed is:

1. A component of a magnetic circuit of a printing head for a dot printer, characterized in that at least one element of said component in the magnetic circuit is configured as a joint body of a plurality of at least two elements joined to each other, one of said elements including magnetic powder and previously molded from a binder and said magnetic powder and thereafter separately debindered to remove said binder at a high temperature and thereafter the two elements being joined by sintering;

wherein said metallic powder is a material exhibiting at least one of a high permeability and a high saturated magnetic flux density.

2. The component of claim 1, wherein said elements are a core (5) and a base frame (2).

3. The component of claim 1, wherein said elements are a plunger (8) and a lever piece (9).

4. A method of forming a component of a magnetic circuit for a printing head for a dot printer, comprising the steps of:

forming at least one magnetic circuit component as a joint body of a plurality of elements, at least one of said elements formed from metallic powder and binder by injection molding followed by the step of separately debindering to remove said binder at a high temperature;

bringing together said at least one debindered element and a second element; and sintering said brought together second element and said previously molded debindered element to join said elements into the component;

said metallic powder being a material exhibiting at least one of a high permeability and a high saturated magnetic flux density.

5. The method as set forth in claim 4, wherein said plurality of elements are a core (5) and a base frame (2).

6. The method as set forth in claim 4, wherein said elements are a plunger (8) and a lever piece (9).

7. The method as set forth in claim 4, wherein the at least one element is formed by the steps of;

kneading a binder with fine powder of a magnetic material;

injection-molding said kneaded substances; and debinding said injection-molded kneaded substances to remove said binder at a high temperature.

8. The method of claim 4, wherein both elements are formed from metallic powder and binder by injection molding and are debindered before sintering.

9. A method of forming a component of a magnetic circuit for a printing head for a dot printer, comprising the steps of:

forming at least one magnetic circuit component as a joint body of a plurality of elements, at least one of said elements formed from metallic powder by injection molding, at least a second of said elements not formed from metallic powder;

sintering said at least one of said previously molded elements and said at least second element to join said elements into said component; and said metallic powder being a material exhibiting at least one of a high permeability and a high saturated magnetic flux density.

10. The method as set forth in claim 9, wherein said second element is brought together with said at least one of said molded elements during the injection molding process and the brought together elements are thereafter sintered.

* * * * *